United States Patent [19]

Labombarde

[11] 4,200,033

[45] Apr. 29, 1980

[54] BOX BLANK FEED, TRANSFER AND GLUEING CONTROL APPARATUS

[76] Inventor: Raymond A. Labombarde, 24 Marlow Rd., Nashua, N.H. 03060

[21] Appl. No.: 878,284

[22] Filed: Feb. 16, 1978

[51] Int. Cl.[2] ..... B31B 1/06; B31B 1/36

[52] U.S. Cl. ..... 93/49 R; 271/35

[58] Field of Search ..... 93/49 R, 52, 45, 48, 93/36 MM; 271/35

[56] References Cited

U.S. PATENT DOCUMENTS

| | | | |
|---|---|---|---|
| 2,285,537 | 6/1942 | Sidebotham | 93/49 R |
| 2,871,772 | 2/1959 | Nelson | 93/49 R X |
| 2,969,719 | 1/1961 | Shenigo | 93/49 R |
| 3,612,512 | 10/1971 | Lang | 271/35 |
| 3,808,958 | 5/1974 | Keener et al. | 93/49 R |

*Primary Examiner*—James F. Coan

*Attorney, Agent, or Firm*—Pearson & Pearson

[57] ABSTRACT

A right angle folder-gluer for folding paper boxes from box blanks has a mechanically actuated, timed, bumper-type magazine feed which feeds flat box blanks individually and successively onto an untimed conveyor in a flap folding zone. The folded blanks are then delivered to a right angle transfer zone in which a mechanically actuated pusher bar transfers each blank onto an untimed conveyor for advance through a glueing and folding zone. The bumper feed and transfer bar are positively, mechanically connected and powered for semi-automatic operation and the pattern glue wheel in the glueing zone is also synchronized with the feed and transfer for full automatic operation.

12 Claims, 7 Drawing Figures

Fig. 6.
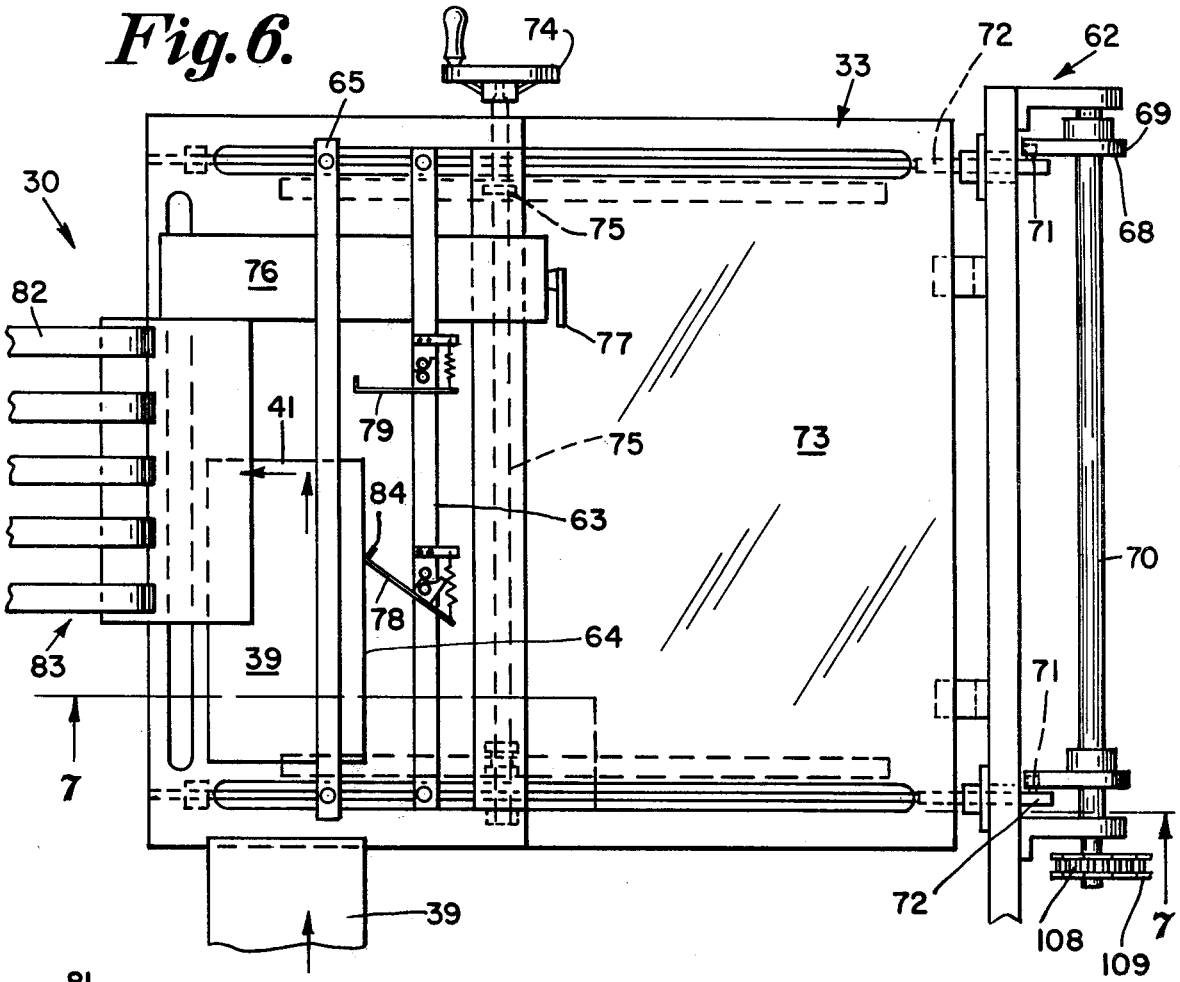
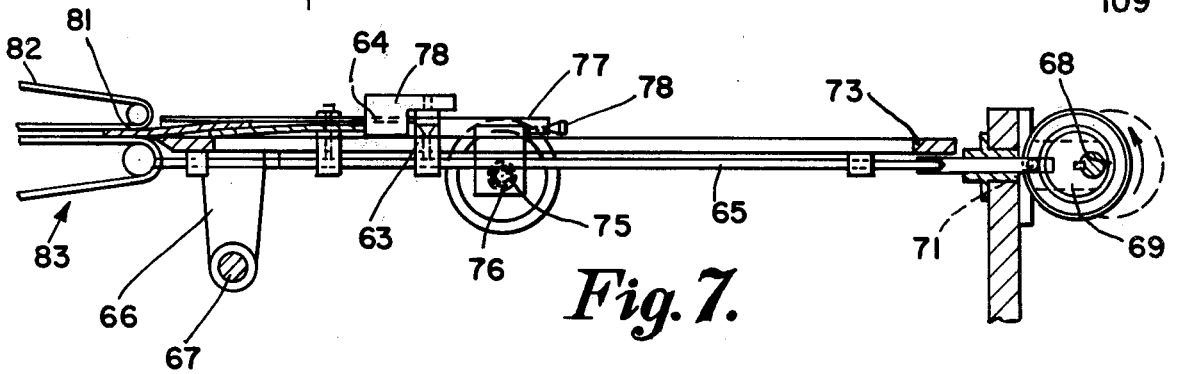
Fig. 7.

BOX BLANK FEED, TRANSFER AND GLUEING CONTROL APPARATUS

BACKGROUND OF THE INVENTION

It has heretofore been proposed to use "bumper" type feeds in the magazines of folding paper box machines for assuring that only the leading edge of the lowermost blank in a stack of identical, flat box blanks will be advanced through the gateway of the magazine guage and along the horizontal paper line of the machine.

One type of bumper feed is disclosed in U.S. Pat. No. 3,406,963 to Goss of Oct. 22, 1968, wherein the upper reaches of a plurality of endless carrier belts advance under the lower surface of the lowermost blank in a stack and are liftable into contact with that surface to advance the lowermost blank by means of cams.

In another type of bumper feed disclosed in U.S. Pat. No. 3,612,512 to Lang of Oct. 12, 1971, the lifting members are between the carrier belts and instead of raising the belts into contact with the lower blank they lift the lower blank out of contact with the belts for controlling feed.

The bumper feed of this invention is timed and of the Lang type in that elongated lifter bars mounted in the space between feed belts, are raised and lowered to conrol the feed of each successive lowermost blank out of the gateway at the bottom of the stack. Such a bumper feed was made and sold by the International Paper Box Machine Company of Nashua, New Hampshire in February 1971 on a straight line folder-gluer.

SUMMARY OF THE INVENTION

In this invention, a right angle folder gluer, capable of handling many different types of box blanks than a straight line folder gluer, is designed to have timed control of the blanks entirely through the machine by means of a mechanical transfer bar, and a mechanically rotated glue pattern wheel both positively and mechanically connected to the bumper feed drive. While timed register lug chains could be used to advance the blanks from the feed zone, through the first fold zone to the transfer zone and from the transfer zone through the glue zone and second fold zone to the discharge zone, the advantage of this invention is that timed control is obtained while using higher speed carrier belts in the first fold and second fold zones, thereby improving speed accuracy and efficiency.

Preferably the lifter bars of the bumper feed, the transfer bar of the transfer mechanism and the pattern glue wheel of the glue zone are all connected, controlled and empowered by the main drive shafts of the power train of the machine so that all are always in perfect synchronization. In the first fold zone and in the second fold zone normal thereto, the walls, flaps and tabs of the blanks are folded by folder bars, belts or hooks in an untimed or article actuated manner with high speed flow and no dependence on the lugs of registration chains.

BRIEF DESCRIPTION OF THE DRAWINGS

FIG. 6 is an enlarged plan view of the transfer mechanism in the transfer zone; and FIG. 7 is a side elevation in section on line 7—7 of FIG. 6.

DESCRIPTION OF A PREFERRED EMBODIMENT

Figure 1:
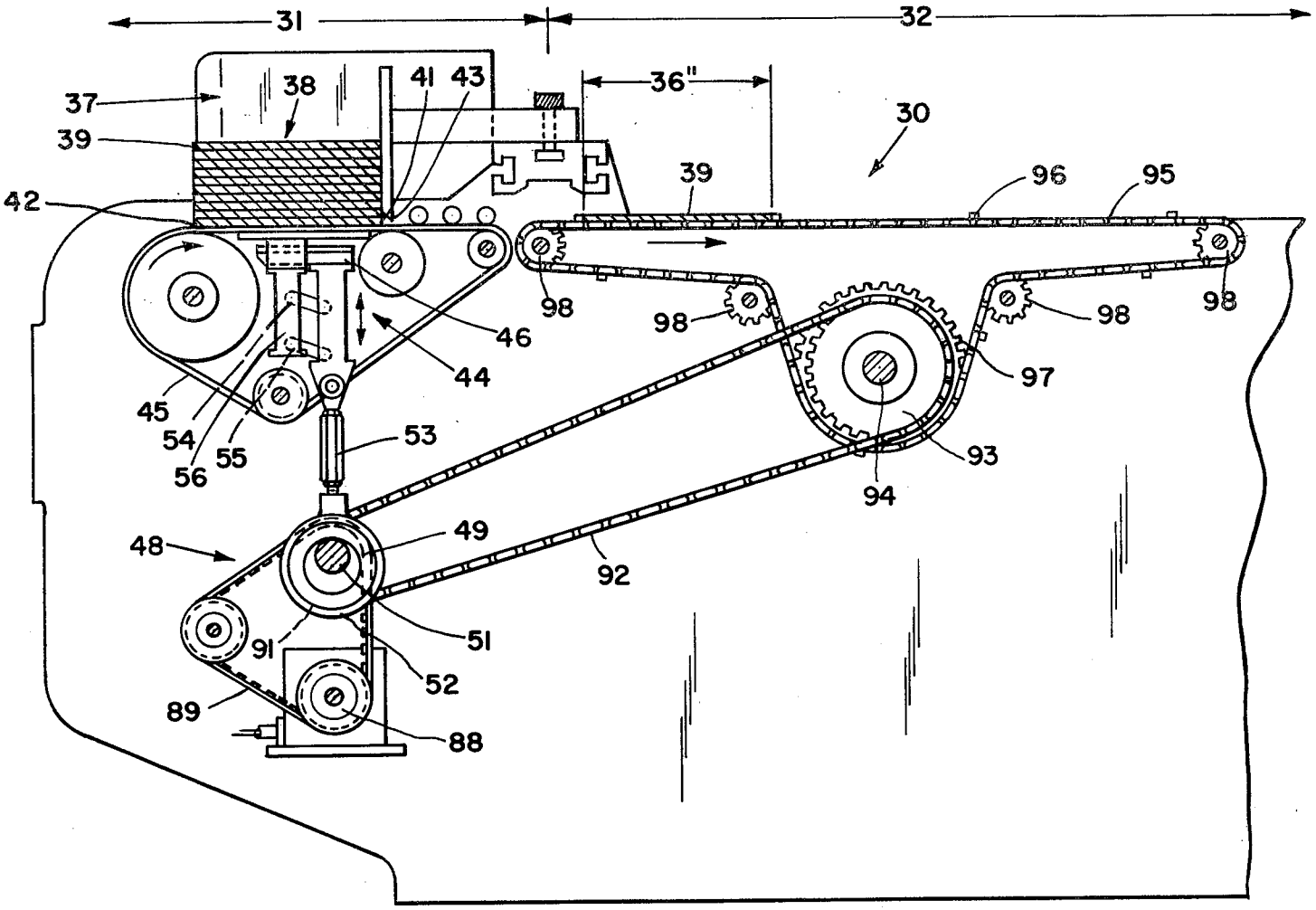
FIG. 1 is a side elevation of a right angle, folder gluer of the invention.

As shown in the drawing, a right angle folder-gluer 30 includes a box blank, or sheet, feeding zone 31, a first folding zone 32, a right angle transfer zone 33, a glueing zone 34, a second folding zone 35 and a discharge zone 36.

A bottom feed magazine 37, in the feed zone 31, supports a stack 38 of carton blanks, or sheets, 39, the leading edge 41 of the lowermost blank 42 being opposite the gateway 43 to permit passage of only one blank 39 at a time.

A bumper type feed mechanism 44 in sheet feeding zone 31 includes a plurality of laterally spaced, endless, feed belts 45 with at least one stack lifter 46 in the space 47 between adjacent belts. Feed control means 48 comprises a rotatable variable eccentric 49 rotated by a shaft 51 and mounted within a yoke 52 to vertically lift and lower the turnbuckle adjustment rod 53 and the stack lifter 46. The stack lifter 46 is guided on the pair of parallel links 54 and 55 which are pivoted to a frame piece 56.

The turnbuckle adjustment rod 53 permits variation in the limit, or length, of travel of the stack lifters 46 in accordance with the variable throw of the eccentric 49. The throw of the eccentric is variable by means of the slots 57, bolts 58 in the yoke 52. The throw of the eccentric is adjustable to conform to the length of the blanks 39 being fed along the paper line of the machine.

Figure 4:
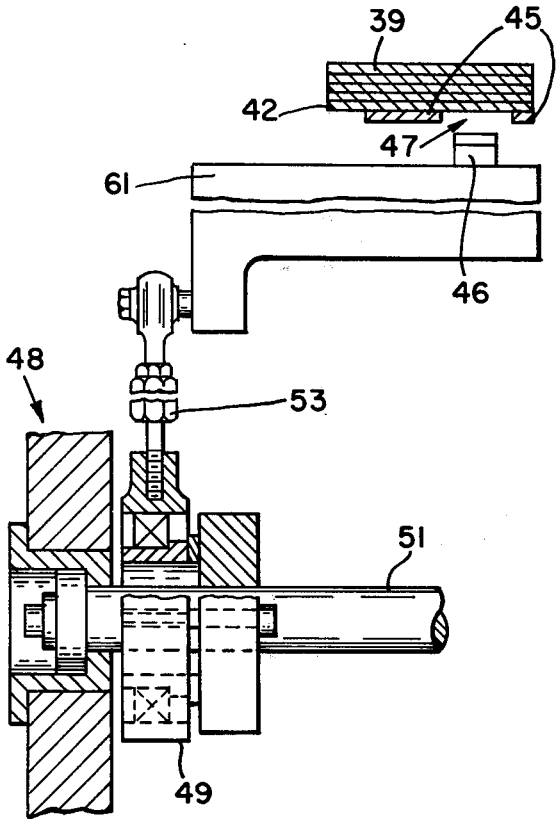
FIG. 4 is a fragmentary end elevation in section on line 4—4 of FIG. 5 showing the bumper feed adjustment.
Figure 5:
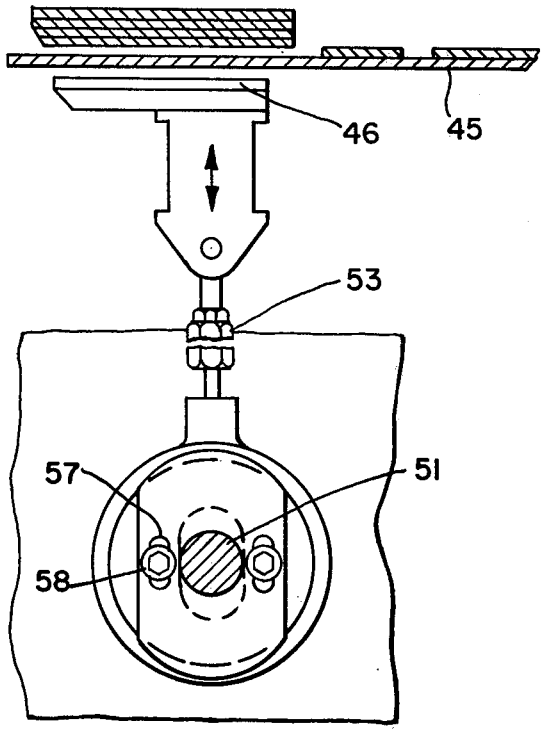
FIG. 5 is a fragmentary side elevation on line 5—5 of FIG. 4.

Preferably as shown in FIG. 4 there are a pair of identical, variable, eccentric mechanisms 49 each adjustable to conform to the length of the blanks in a run and each supporting one end of a cross piece 61, the cross piece 61 carrying the stack lifter bars 46.

A mechanically actuated, positive, right angle, transfer means 62 is provided in transfer zone 33 of the right angle folder gluer 30 and includes a pusher element, or bar, 63 movably mounted in position to engage the side edge 64 of each folded blank 39, advanced into the zone 33 and to push the blank, in a direction normal to its previous direction of advance, over into the glueing zone 34.

As best shown in FIGS. 6 and 7 the mechanical transfer means 62 includes a reciprocable carriage 65 mounted for lateral motion on brackets 66 slidably adjustable on a rod 67 and an eccentric 68 rotatable in a yoke 69 on a shaft 70, the yoke 69 being connected by pin 71 and crank 72 to the carriage to impart reciprocation thereto. A transparent cover 73 in zone 33 holds down the folded flaps, walls or tabs of the blanks while the folded blanks move through the zone. A turn handle 74 and threaded mechanism 75 permits manual adjustment of a backstop 76 which is in the path of the leading edge 41 of each blank 39 to align the edge properly for advance into the glueing zone. A threaded lock 77 holds the back stop at the desired location.

A pair of spring biased, pivoted fingers 78 and 79 are mounted on pusher bar 63 and arranged to yield resiliently under impact of the leading edge of an entering blank as the carriage is on its retraction stroke. Thus one blank can be advancing under the influence of the nip 81 of carrier belts 82 of the second conveyor means 83, while the carriage retracts and the next successive blank advances into the transfer zone and under the preceding blank (FIG. 6) thus avoiding the delay of waiting for the preceding blank to clear the zone. While the fingers yield (as shown in FIG. 6) the right angular tips 84 thereof spring back into position to push the side edges 64 of the blanks in a direction normal to the path through the first folding zone.

Figure 2:
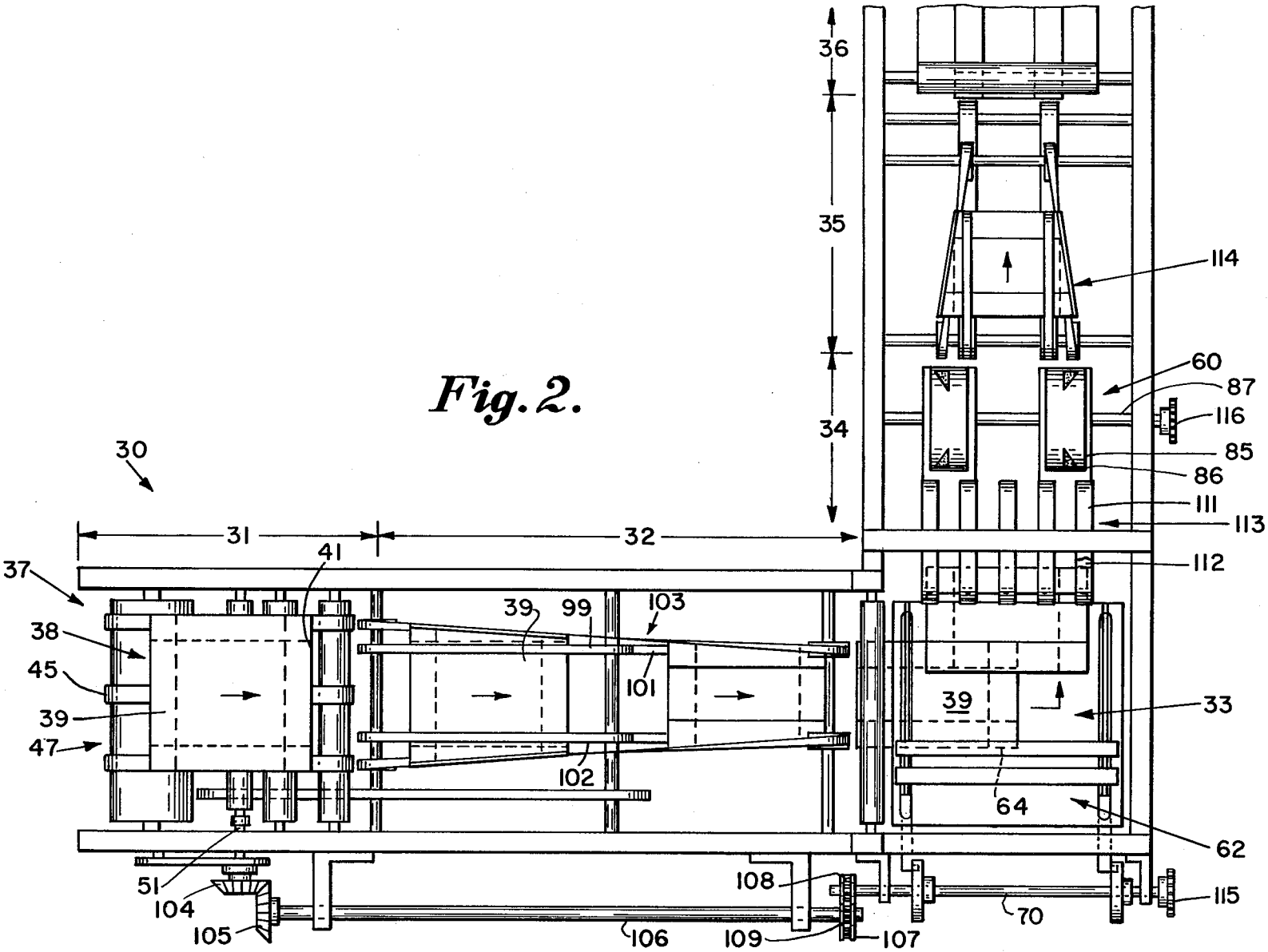
FIG. 2 is a plan view thereof showing the bumper feed positively connected mechanically to the right angle transfer arm in semi timed relationship.

A conventional glue pot means 60 may be mounted in glueing zone 34, to apply a strip of adhesive along a portion of each successive blank passing thereunder or thereabove, through the glueing zone (FIG. 2). However, a pattern gluer 85, having one or more pattern glue wheels 86 rotated by a shaft 87 is preferably provided so that a pattern of adhesive spots may be deposited on selected portions of blanks passing thereunder.

As shown in FIG. 1, in one form of the invention, the feed drive shaft 51 of feed control means 48 is driven by a variable speed drive unit and motor 88 by timing belt, or chain, 89. A sprocket 91 on shaft 51 is connected by chain 92 to a sprocket 93 on shaft 94, shaft 94 driving the registration chain 95 with its spaced, upstanding registration lugs 96 by means of sprocket 97 and idler sprockets 98. Each individual and successive lowermost blank 42 in the vertical stack 38 of magazine 37 is thus fed by the lifter bars 46 of the bumper feed 44, through the gateway 43 onto chain 95 in precise synchronization with the arrival of a registration lug 96 and is carried through the first folding zone 32 for precise, timed folding by the first folding means 97. Pattern, or spot, glueing is thus possible in the first folding zone, if desired by operably connecting the shaft of the pattern glue wheels to the feed control means or to the registration chain sprocket shafts.

The registration chain lugs can be set at twelve inches, eighteen inches or thirty six inches apart to accomodate blanks of such lengths and the bumper feed can be adjusted to feed one blank along the paper line to be engaged by each such lug. Instead of first and second registration chain conveyor means, in the first folding zone and in the glueing and second folding zones, it has been found that the feed, transfer and glueing control apparatus 98 of the invention permits untimed endless carrier belt conveyors to advance the blanks along the paper line for much more rapid article actuated folding.

Thus as shown in FIGS. 2, 3, 6 and 7, a pair of upper and lower carrier belts 99 and 101, extending along the first folding zone 32, receive each successive blank from magazine 37 and advance the blanks individually and successively in spaced formation along the horizontal paper line in the elongated nip 102 thereof. Thus while the bumper feed 44 is timed the first conveyor means 103 comprising belts 99 and 101 is untimed, the folding is article actuated, or by elongated folder bars or belts of known type, and delivery into the right angle transfer zone 33 is untimed.

In right angle transfer zone 33, timed control is regained by reason of the gear 104, driven by the shaft 51 of the bumper feed 44, and driving gear 105 on shaft 106, shaft 106 positively driving shaft 70 of transfer means 62 through sprockets 107 and 108 and chain 109.

A semi-timed control of the blanks is thus achieved, together with the high speed and accurate folding of the untimed conveyor belts and untimed folding means.

Figure 3:
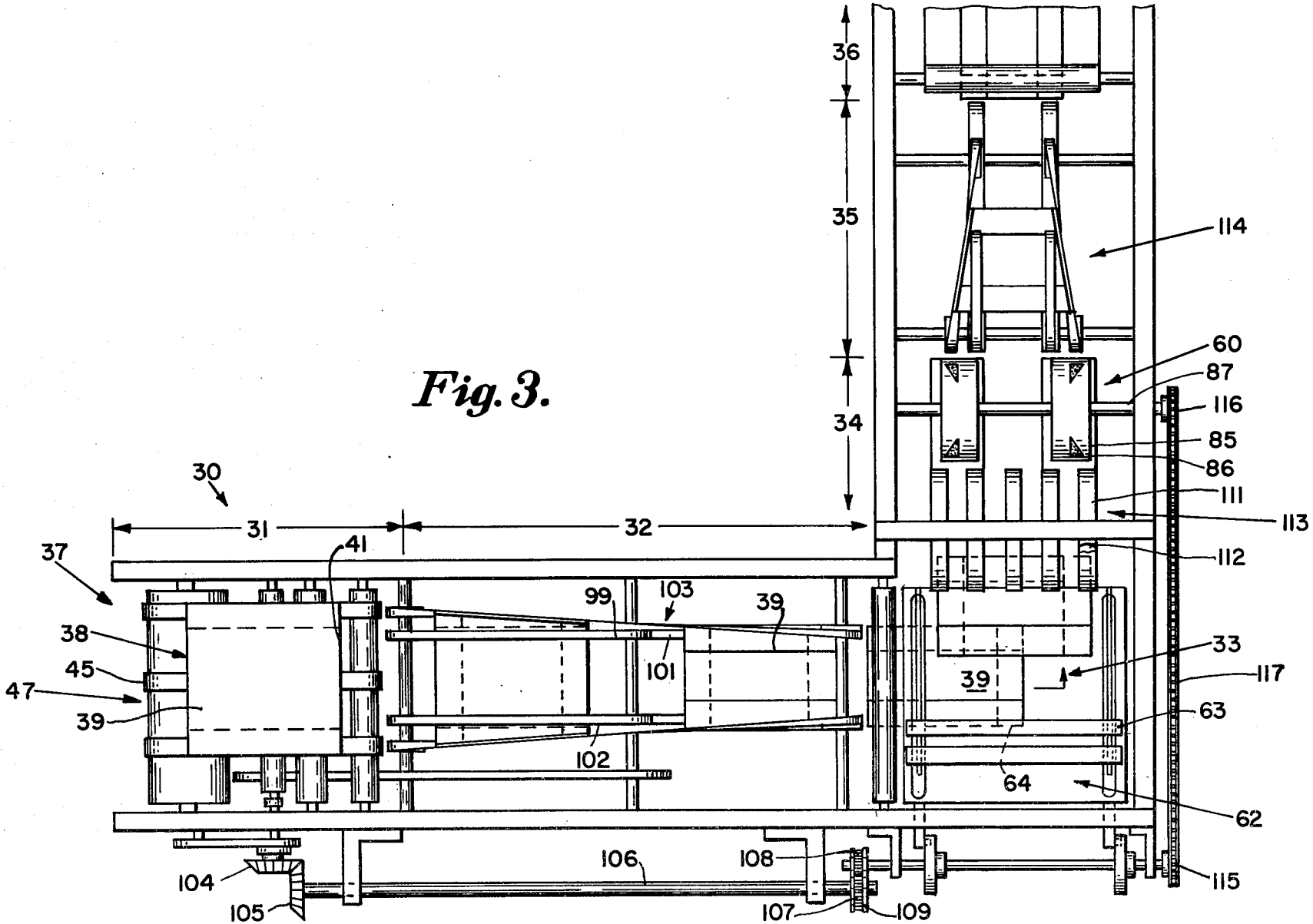
FIG. 3 is a plan view similar to FIG. 2 showing the bumper feed, right angle transfer bar and pattern glue wheel positively connected in fully timed relationship.

To obtain fully timed operation of the right angle folder gluer 30, while still having untimed carrier belts and folding mechanism, a pair of upper and lower endless carrier belts 111 and 112 form the second conveyor means 113 for advancing the blanks received from the transfer zone 33 along a horizontal path, normal to the path through the first folding zone, and extending to the glueing zone 34 and from zone 34 to the second folding zone 35. Suitable second folding means 114 in the form of article actuated hooks, folder bars or folder belts of known type are provided for completing the glueing and folding of each blank to form a flat collapsed carton or tray. Full timing is obtained by connecting the shaft 87 of the pattern glue wheels 86 to the shaft 70 of the right angle transfer means by sprockets 115 and 116 and chain 117 (FIG. 3). Thus the bumper feed controls the timing of the feed, transfer and pattern glueing while the blanks advance at high speed between the zones in untimed but accurately spaced relation and the control is achieved entirely by mechanical drive means without reliance on electric switches, photo cells, spring transfer or other relatively unreliable and sometimes inaccurate connections.

I claim:

1. In a carton folder and gluer of the right angle type having a feed zone, a first folding zone, a transfer zone, a gluing zone and a second fold zone, the combination of:

timed feed means in said feed zone for advancing carton blanks individually and successively from a magazine into said first folding zone;

first endless carrier belt conveyor means in said first folding zone for advancing said blanks individually and successively along a path through said first folding zone;

folding means in said first folding zone for folding each successive blank advancing therethrough along fold lines extending in the direction of said path;

blank transfer menas including a mechanically actuated pusher bar in said transfer zone for moving each said folded blank in a direction normal to said path into said gluing zone;

second endless carrier belt conveyor means in said gluing zone and in said second folding zone for advancing said blanks individually and successively along a path through said glueing and second folding zones;

gluing means including a pattern glue roll in said gluing zone for gluing each successive blank and second folding means in said second folding zone for folding each glued blank advancing therethrough;

and mechanical drive means including a common drive train, positively connecting said feed means to said pusher bar of said transfer means for synchronizing the right angle transfer of each blank with the feed thereof.

2. A carton folder gluer as specified in claim 1 wherein:

said common drive train of said mechanical drive means positively connects said feed means, said pusher bar of said blank transfer means and said pattern roll of said gluing means for synchronizing the right angle transfer, the feed and the pattern gluing of each blank.

3. A carton folder and gluer of the right angle type having a sheet magazine; sheet feeder means; first conveyor means extending along a first folding zone to a right angle transfer zone; sheet transfer means in said zone; second conveyor means extending along a second folding zone at right angles to said first zone; folding means in said first and second zones and glueing means in said second zone, characterized by;

said sheet feeder means comprising:

laterally spaced feed belt means continuously moving in the direction of feed under a stack of sheets in said magazine and through a sheet gateway, adapted to pass one sheet only at a time, up to said first conveyor means;

at least one stack lifter located in the space between adjacent feed belts, and mounted to move in a vertical path to lift and lower said stack to cause each successive lowermost sheet therein to engage said feed belts and be advanced through said gateway;

feed control means for actuating said stack lifter, comprising a rotatable, variable, eccentric for lifting and lowering said stack lifter with a preselected throw conforming to the length of the sheets being fed; drive means for rotating said eccentric at a predetermined speed for synchronizing the same with the speed of said first conveyor means, and turnbuckle means connecting said stack lifter with said eccentric for varying limits of travel of said lifter in accordance with the variable throw of said eccentric.

4. Apparatus as specified in claim 3 wherein:

said drive means is a positive drive train connecting the said rotatable eccentric to the drive of said first conveyor means and said first conveyor means is a timed registration chain;

whereby said feed is exactly synchronized with the registration lugs of said chain.

5. Apparatus as specified in clain 4 wherein:

said drive means is a variable speed drive unit and said first conveyor means is a lug carrying registration chain whereby said stack lifter serves as a means for spacing said sheets to handle odd shaped, flat carton blanks and permit any given sized sheet to be fed into any given sized spacing.

6. In a right angle folder gluer of the type having a sheet magazine; first sheet conveyor means extending along a first folding zone to a transfer zone; second sheet conveyor means extending along a gluing zone and a second folding zone, at right angles to said first folding zone; folding means in said first and second zones and gluing means in said gluing zone; the combination of:

feed control means operably connected to said magazine for feeding each sheet in a stack in said magazine individually and successively to said first conveyor means for advance through said first folding zone;

mechanical sheet transfer means in said transfer zone, including a pusher bar with pusher elements movably mounted thereon for engaging the side edge of a sheet advanced into said transfer zone by said first sheet conveyor means and pushing said sheet in a direction normal thereto into said second sheet conveyor means, and drive means including a common drive train positively connecting said feed control means to the pusher bar of said mechanical sheet transfer means for precisely synchronizing the same said first conveyor means being endless untimed, carrier belts and said folding means in said first folding zone being untimed and sheet actuated.

7. A right angle folder gluer as specified in claim 6 wherein:

said gluing means includes a pattern glue roll for applying a predetermined pattern of adhesive on said sheets and drive means positively connecting the pattern glue roll of said gluing means to the pusher bar of said mechanical sheet transfer means, whereby said feed control means, the pusher bar of said sheet transfer means and the pattern glue roll of said gluing means are fully timed and synchronized while permitting the use of said endless untimed carrier belts and said article actuated folding means in said first and second folding zones.

8. A right angle folder gluer as specified in claim 6 wherein:

said feed control means is of the "bumper" feed type with a variable eccentric for lifting and lowering the bumper, and said variable eccentric is positively connected to the drive of said mechanical sheet transfer means by a common drive shaft.

9. A right angle folder gluer as specified in claim 6 wherein:

said mechanical sheet transfer means includes a crank for reciprocating said pusher bar; a drive shaft, for turning said crank, driven by connection to said feed control means and said pusher elements are a pair of spring biased, pivoted pusher fingers adapted to yield to the leading edge of a sheet entering said transfer zone and spring back to engage the side edge of said blank for pushing the same.

10. A right angle folder gluer as specified in claim 6 wherein:

said mechanical sheet transfer means includes a carriage supporting said pusher bar, means for adjusting the position of said carriage in said transfer zone and a backstop movably positioned on said carriage whereby said transfer means may be adjusted to conform to the dimensions of sheets of different sizes.

11. In a right angle folder gluer the combination of:

a sheet magazine having a sheet gateway for passing one sheet at a time;

first endless carrier belts extending along a path through a first folding zone to a sheet transfer zone;

second endless carrier belts extending along a path normal to said first path from said transfer zone to a glueing zone and from said glueing zone through a second folding zone;

sheet actuated folding means in said first and second folding zones and glueing mechanism in said glueing zone;

a bumper type feed control means, operatively connected with said magazine, and having a rotatable variable eccentric raising and lowering a stack lifter with relation to a continuously advancing feed conveyor to feed the lowermost sheet when the stack is down and cease feed when the stack is up;

a mechanically actuated sheet transfer means, in said transfer zone, having a pusher bar with spring biased pusher fingers pivoted thereon and a crank for reciprocating said bar in a path normal to said first endless carrier belts; and a common drive train positively connecting said rotatable variable eccentric with said crank for synchronizing said feed control with said sheet transfer.

12. A right angle folder gluer as specified in claim 11 plus:

a pattern glue applying wheel in said glueing mechanism rotatable on a shaft, and a second common drive train positively connecting said rotatable pattern glue wheel shaft with said crank and with said variable eccentric for synchronizing said feed control, sheet transfer and pattern glueing.

* * * * *